US010048606B2

(12) United States Patent
Asakawa

(10) Patent No.: US 10,048,606 B2
(45) **Date of Patent: *Aug. 14, 2018**

(54) ELECTROSTATIC LATENT IMAGE DEVELOPING TONER

(71) Applicant: KYOCERA Document Solutions Inc., Osaka (JP)

(72) Inventor: Tomoyasu Asakawa, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/639,648

(22) Filed: Jun. 30, 2017

(65) Prior Publication Data

US 2018/0017884 A1 Jan. 18, 2018

(30) Foreign Application Priority Data

Jul. 13, 2016 (JP) ..... 2016-138552

(51) Int. Cl.

| | |
|---|---|
| ***G03G 9/093*** | (2006.01) |
| ***G03G 9/087*** | (2006.01) |
| ***G03G 9/08*** | (2006.01) |
| ***G03G 9/09*** | (2006.01) |

(52) U.S. Cl.

CPC ..... *G03G 9/08755* (2013.01); *G03G 9/0819* (2013.01); *G03G 9/0821* (2013.01); *G03G 9/0918* (2013.01); *G03G 9/09321* (2013.01); *G03G 9/09371* (2013.01); *G03G 9/09392* (2013.01)

(58) Field of Classification Search

CPC ..... G03G 9/09307; G03G 9/09321

See application file for complete search history.

(56) References Cited

U.S. PATENT DOCUMENTS 9,804,517 B2 * 10/2017 Tsuchihashi ..... G03G 9/0825

FOREIGN PATENT DOCUMENTS

JP 2001-201891 A 7/2001

* cited by examiner

*Primary Examiner* — Peter L Vajda

(74) *Attorney, Agent, or Firm* — Studebaker & Brackett PC

(57) ABSTRACT

An electrostatic latent image developing toner includes a plurality of toner particles each including a core and a shell layer. The shell layer includes a first domain that is a non-crosslinked resin film and second domains that are crosslinked resin particles. The crosslinked resin has a higher glass transition point than the non-crosslinked resin. In a cross-sectional image of a toner particle, a proportion of a total length of a surface region of the core covered by the first domain is at least 45% and no greater than 80% relative to a circumferential length of the core. In a cross-sectional image of a toner particle, a proportion of second domains adhering to a surface of the first domain is at least 30% by number and no greater than 70% by number relative to all the second domains included in the toner particle.

11 Claims, 3 Drawing Sheets

ELECTROSTATIC LATENT IMAGE DEVELOPING TONER

INCORPORATION BY REFERENCE

The present application claims priority under 35 U.S.C. § 119 to Japanese Patent Application No. 2016-138552, filed on Jul. 13, 2016. The contents of this application are incorporated herein by reference in their entirety.

BACKGROUND

The present disclosure relates to an electrostatic latent image developing toner.

Toner particles included in a capsule toner each include a core and a shell layer (capsule layer) disposed over a surface of the core. In an example of methods for producing the capsule toner, cores (toner cores) are mixed with particulates of two resins having different glass transition points (glass transition temperatures) from each other to form the shell layer on a surface of each core.

SUMMARY

An electrostatic latent image developing toner according to the present disclosure includes a plurality of toner particles each including a core and a shell layer disposed over a surface of the core. The shell layer includes at least one first domain having a film shape and second domains each having a particle shape. The at least one first domain is substantially formed from a non-crosslinked resin. The second domains are substantially formed from a crosslinked resin. The crosslinked resin has a higher glass transition point than the non-crosslinked resin. In a cross-sectional image of one of the plurality of toner particles, a proportion of a total length of at least one surface region of the core covered by the at least one first domain is at least 45% and no greater than 80% relative to a circumferential length of the core. In a cross-sectional image of one of the plurality of toner particles, a proportion of second domains adhering to a surface of the at least one first domain is at least 30% by number and no greater than 70% by number relative to all the second domains included in the toner particle.

DETAILED DESCRIPTION

Figure 1:
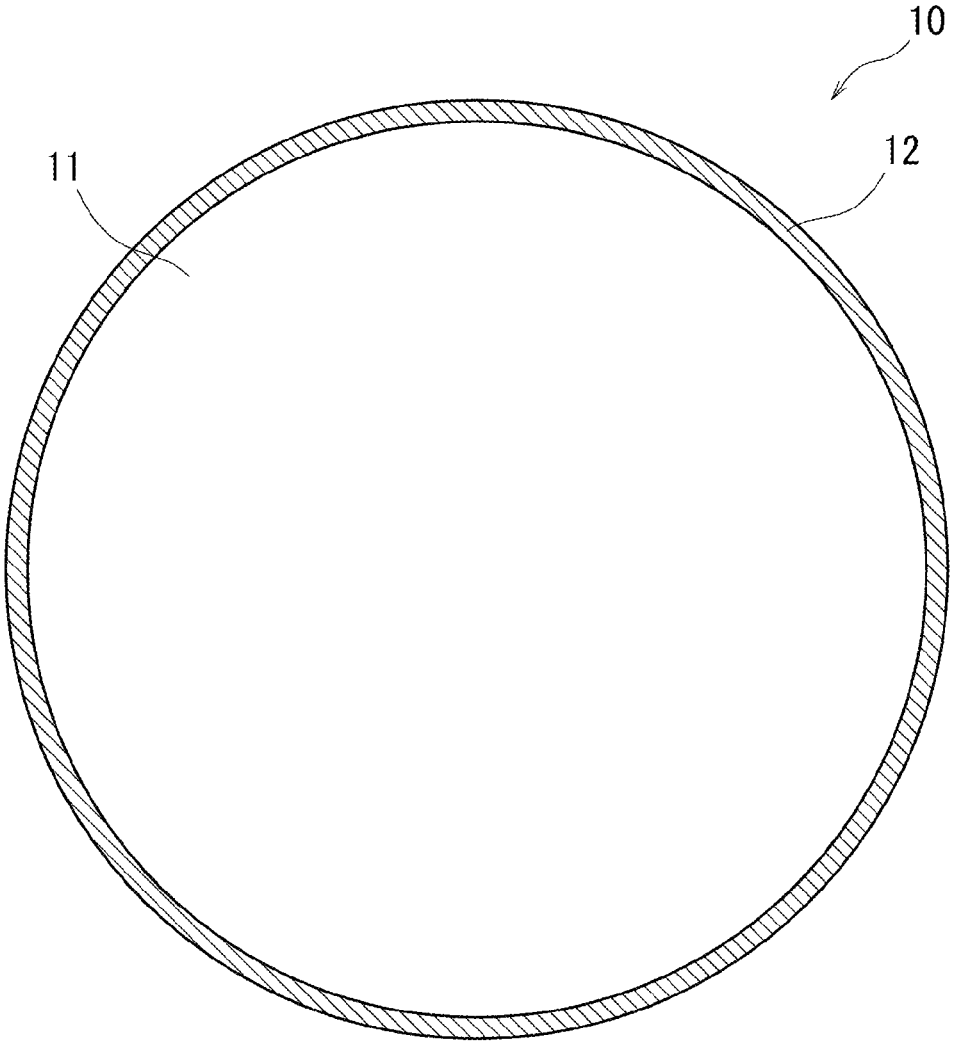
FIG. 1 is a diagram illustrating an example of a cross-sectional structure of a toner particle (particularly, toner mother particle) included in an electrostatic latent image developing toner according to an embodiment of the present disclosure.

The following describes an embodiment of the present disclosure in detail. Evaluation results (for example, values indicating a shape and physical properties) for a powder (specific examples include toner cores, toner mother particles, an external additive, and a toner) are each a number average of values measured for a suitable number of particles of the powder, unless otherwise stated.

A number average particle diameter of a powder is a number average value of equivalent circular diameters of primary particles of the powder (diameters of circles having the same areas as projected areas of the particles) measured using a microscope, unless otherwise stated. A value for volume median diameter ($D_{50}$) of a powder was measured using "Coulter Counter Multisizer 3" manufactured by Beckman Coulter, Inc., unless otherwise stated. An acid value and a hydroxyl value were measured in accordance with "Japanese Industrial Standard (JIS) K0070-1992", unless otherwise stated. A number average molecular weight (Mn) and a mass average molecular weight (Mw) were measured by gel permeation chromatography, unless otherwise stated.

In the following description, the term "-based" may be appended to the name of a chemical compound in order to form a generic name encompassing both the chemical compound itself and derivatives thereof. Also, when the term "-based" is appended to the name of a chemical compound used in the name of a polymer, the term indicates that a repeating unit of the polymer originates from the chemical compound or a derivative thereof. Furthermore, the term "(meth)acryl" is used as a generic term for both acryl and methacryl.

A toner according to the present embodiment can be favorably used for example as a positively chargeable toner for development of an electrostatic latent image. The toner of the present embodiment is a powder including a plurality of toner particles (particles each having features described below). The toner may be used as a one-component developer. Alternatively, the toner may be mixed with a carrier using a mixer (for example, a ball mill) in order to prepare a two-component developer. In order to form a high-quality image, a ferrite carrier (specifically, powder of ferrite particles) is preferably used as the carrier. Also, in order to form a high-quality image for an extended period of time, magnetic carrier particles each including a carrier core and a resin layer covering the carrier core are preferably used. In order to impart magnetism to carrier particles, carrier cores may be formed from a magnetic material (for example, ferrite) or a resin in which magnetic particles are dispersed. Alternatively, magnetic particles may be dispersed in the resin layer covering the carrier core. The resin layer is formed from for example at least one resin selected from the group consisting of fluororesins (specific examples include PFA and FEP), polyamide-imide resins, silicone resins, urethane resins, epoxy resins, and phenolic resins. In order to form a high-quality image, an amount of the toner in the two-component developer is preferably at least 5 parts by mass and no greater than 15 parts by mass relative to 100 parts by mass of the carrier. The carrier particles preferably have a particle diameter of at least 20 μm and no greater than 120 μm. Note that a positively chargeable toner included in a two-component developer is positively charged by friction with a carrier.

The toner particles included in the toner according to the present embodiment each include a core (hereinafter referred to as a toner core) and a shell layer (capsule layer) disposed over a surface of the toner core. The toner core contains a binder resin. Also, the toner core may contain internal additives (for example, a colorant, a releasing agent, a charge control agent, and a magnetic powder). An external additive may be caused to adhere to a surface of the shell layer (or a surface region of the toner core that is not covered by the shell layer). The external additive may be omitted if unnecessary. Hereinafter, a toner particle prior to adhesion of an external additive thereto will be referred to as a toner mother particle. Also, a material used for forming the shell layer will be referred to as a shell material.

The toner according to the present embodiment can be used for image formation for example in an electrophotographic apparatus (image forming apparatus). The following describes an example of image forming methods using an electrophotographic apparatus.

Initially, an image forming section (a charger and a light exposure device) of the electrophotographic apparatus forms an electrostatic latent image on a photosensitive member (for example, a surface of a photosensitive drum) based on image data. Subsequently, a developing device (specifically, developing device loaded with a developer including a toner) of the electrophotographic apparatus supplies the toner to the photosensitive member to develop the electrostatic latent image formed on the photosensitive member. The toner is charged by friction with a carrier, a developing sleeve, or a blade in the developing device before being supplied to the photosensitive member. For example, a positively chargeable toner is charged positively. In the developing process, the toner (specifically, the charged toner) on the developing sleeve (for example, on a surface of a development roller in the developing device) disposed in the vicinity of the photosensitive member is supplied to the photosensitive member to adhere to the electrostatic latent image on the photosensitive member, whereby a toner image is formed on the photosensitive member. The developing device is replenished with toner for replenishment use from a toner container in compensation for consumed toner.

In a subsequent transfer process, a transfer device of the electrophotographic apparatus transfers the toner image on the photosensitive member to an intermediate transfer member (for example, a transfer belt) and further transfers the toner image from the intermediate transfer member to a recording medium (for example, paper). Thereafter, a fixing device (fixing method: nip fixing performed using a heating roller and a pressure roller) of the electrophotographic apparatus fixes the toner to the recording medium by applying heat and pressure to the toner. As a result, an image is formed on the recording medium. For example, a full-color image can be formed by superimposing toner images in four different colors: black, yellow, magenta, and cyan. Note that the transfer process may be a direct transfer process by which the toner image on the photosensitive member is transferred directly to the recording medium not via the intermediate transfer member. Also, a belt fixing method may be adopted as a fixing method.

The toner according to the present embodiment is an electrostatic latent image developing toner having features (hereinafter referred to as basic features) described below.

(Basic Features of Toner)

The electrostatic latent image developing toner includes a plurality of toner particles each including a toner core and a shell layer. The shell layer includes at least one first domain having a film shape and second domains each having a particle shape. The at least one first domain is substantially formed from a non-crosslinked resin. The second domains are substantially formed from a crosslinked resin. The crosslinked resin has a higher glass transition point (Tg) than the non-crosslinked resin. In a cross-sectional image of a toner particle, a proportion of a total length of at least one surface region of the toner core covered by the at least one first domain is at least 45% and no greater than 80% relative to a circumferential length of the toner core. In a cross-sectional image of a toner particle, a proportion of second domains adhering to a surface of the at least one first domain is at least 30% by number and no greater than 70% by number relative to all the second domains included in the toner particle. The first domain may be a film without granular appearance or a film with granular appearance.

Hereinafter, a proportion of a total length of at least one surface region of a toner core covered by the at least one first domain relative to a circumferential length of the toner core determined in a cross-sectional image of a toner particle may be referred to as "first coverage". Also, a proportion of a total length of surface regions of a toner core covered by at least one of the first domain and the second domains relative to a circumferential length of the toner core determined in a cross-sectional image of a toner particle may be referred to as "second coverage". Furthermore, a proportion of the number of second domains adhering to a surface of the at least one first domain relative to the number of all the second domains included in a toner particle determined in a cross-sectional image of the toner particle may be referred to as "multiple coverage".

The toner having the above-described basic features hardly contaminates a carrier and is excellent in both high-temperature preservability and fixability. Functions and effects of the above-described basic features will be described in detail below.

For example, high-temperature preservability of the toner can be improved by covering each toner core with a resin film. Resin particles can be used as a material for forming the resin film. The resin film can be formed by melting (or deforming) the resin particles and hardening them into a film shape. When the resin film is formed on a surface of each toner core using non-crosslinked resin particles having a low glass transition point (Tg), a wide area of the surface of each toner core can be covered by a thin resin film (non-crosslinked resin film having a low Tg). However, the thus formed non-crosslinked resin film tends to have significant variation in thickness. Variation in film thickness as above is thought to be caused due to agglomeration of the resin particles. When a large proportion of a surface area of each toner core is exposed from the resin film (not covered by the resin film), high-temperature preservability of the toner tends to be impaired. By contrast, when a thickness of the resin film is increased in order to cover the entire surface area of each toner core by the resin film, low-temperature fixability of the toner tends to be impaired.

The inventor has found that sufficient high-temperature preservability of the toner can be achieved by covering incompletely (at low coverage) the surface of each toner core with a non-crosslinked resin film and filling gaps in the film with crosslinked resin particles. It is considered that even in a configuration in which the first coverage (that is, coverage by the non-crosslinked resin film) is low, sufficient high-temperature preservability of the toner can be achieved easily since crosslinked resin particles adhering to the surface of the toner core and a surface of the non-crosslinked resin film function as spacers between toner particles.

In the toner having the above-described basic features, the first coverage (specifically, proportion of a total length of at least one surface region of a toner core covered by the at least one first domain relative to a circumferential length of the toner core determined in a cross-sectional image of a toner particle) is at least 45% and no greater than 80%. The at least one surface region of the toner core covered by the at least one first domain (hereinafter may be referred to as first covered region) includes a surface region of the toner core covered by the first domain only and a surface region of the toner core covered by both the first domain and the second domains. The first coverage (unit: %) is represented by an expression "first coverage=100×(total length of first covered region)/(circumferential length of toner core)". In a configuration in which the first domain is too thick, the first coverage is too high, and low-temperature fixability of the toner tends to be impaired. In a configuration in which the first coverage is too low, many second domains are necessary for assuring high-temperature preservability of the toner, and it is thought to be difficult to achieve both high-temperature preservability and low-temperature fixability of the toner.

Further, in the toner having the above-described basic features, the shell layer includes the film-shaped first domain and the particle-shaped second domains. The first domain is substantially formed from a non-crosslinked resin. The second domains are substantially formed from a crosslinked resin. The crosslinked resin has a higher glass transition point (Tg) than the non-crosslinked resin. Both high-temperature preservability and low-temperature fixability of the toner can be achieved by covering each toner core with the first domain (non-crosslinked resin film having a low Tg) and the second domains (crosslinked resin particles having a high Tg). Due to the presence of the second domains in surface regions of each toner core where the toner core is exposed from the first domain, high-temperature preservability of the toner can be improved while assuring low-temperature fixability of the toner with a relatively small thickness of the first domain.

Tg of the crosslinked resin is particularly preferably at least 45° C. higher than Tg of the non-crosslinked resin. The second domains, which have a comparatively high Tg, are thought to contribute to improvement in heat resistance of the toner particles. In order to form a high-quality shell layer, a difference (=Tg of crosslinked resin −Tg of non-crosslinked resin) obtained by subtracting Tg of the non-crosslinked resin from Tg of the crosslinked resin is preferably at least 45° C. and no greater than 65° C. The respective glass transition points (Tg) of the crosslinked resin and the non-crosslinked resin can be adjusted for example by changing components (monomers) of the respective resins or amounts (blend ratios) thereof.

In order to achieve both high-temperature preservability and low-temperature fixability of the toner, the second coverage (proportion of a total length of surface regions of a toner core covered by at least one of the first domain and the second domains relative to a circumferential length of the toner core determined in a cross-sectional image of a toner particle) is preferably at least 70% and no greater than 99%. The surface regions of the toner core covered by at least one of the first domain and the second domains (hereinafter may be referred to as second covered regions) include a surface region of the toner core covered by the first domain only, a surface region of the toner core covered by the second regions only, and a surface region of the toner core covered by both the first region and the second regions (specifically, the first region and the second regions located on the first region). The second coverage (unit: %) is represented by an expression "second coverage=100×(total length of second covered regions)/(circumferential length of toner core)".

In the toner having the above-described basic features, the multiple coverage (specifically, proportion of second domains adhering to a surface of the at least one first domain relative to all the second domains included in a toner particle determined in a cross-sectional image of the toner particle) is at least 30% by number and no greater than 70% by number. The inventor has found that a toner that hardly contaminates a carrier and that is excellent in high-temperature preservability and low-temperature fixability can be easily obtained in a configuration in which the multiple coverage is at least 30% by number and no greater than 70% by number. In a configuration in which the multiple coverage is too high, it is difficult to achieve sufficient low-temperature fixability of the toner. Also, in a configuration in which the multiple coverage is too high, the second domains (crosslinked resin particles) of the shell layer tend to migrate from the toner to a carrier during continuous printing and carrier contamination (phenomenon in which a foreign substance adheres to carrier particles) tends to occur. Occurrence of carrier contamination tends to result in decrease in a charge giving property (property of charging the toner) of the carrier. By contrast, in a configuration in which the multiple coverage is too low, it is difficult to achieve sufficient high-temperature preservability of the toner.

In order that the multiple coverage is at least 30% by number and no greater than 70% by number, the toner core preferably has a lower glass transition point than the non-crosslinked resin forming the first domain. The first domain (specifically, non-crosslinked resin film) can be formed on the surface of each toner core for example by maintaining a dispersion including a material for the first domain and toner cores at a high temperature to melt a surface (for example, a binder resin) of each toner core in the liquid and cause fusion of the material for the first domain with the toner core. As a result of fusion of the first domain with the toner core, bonding strength between the first domain and the toner core is high, and the first domain is prevented from being separated from the toner core. Further, the second domains (specifically, crosslinked resin particles) can be formed on the surface of each toner core and a surface of the first domain by mixing the toner cores (specifically, toner cores with the first domain formed thereon) and the crosslinked resin particles (powder) for example using a mixer (stirrer) including a stirring impeller. When the crosslinked resin particles impinge on each toner core with mechanical impact force, a part (bottom) of each crosslinked resin particle is embedded in the surface of the toner core. Since the second domains are fixed to the toner core such that a part of each second domain is embedded in the toner core, bonding strength between the toner core and the second domains is high, and the second domains are prevented from being separated from the toner core. The second domains tend to adhere more strongly to the surface of the toner core than to the surface of the first domain.

In a situation in which the toner core has a lower glass transition point than the non-crosslinked resin forming the first domain, the multiple coverage can be easily adjusted to at least 30% by number and no greater than 70% by number by mixing the crosslinked resin particles and the toner cores with the first domain formed thereon in an appropriately heated environment. Specifically, in a situation in which the toner core has a relatively low glass transition point, adhesiveness of the surface of the toner core tends to vary depending on a mixing temperature. Adhesiveness of the surface of the toner core increases with an increase in the mixing temperature and as a consequence the crosslinked resin particles tend to adhere to the surface of the toner core. Therefore, the multiple coverage can be decreased by increasing the mixing temperature, and can be increased by decreasing the mixing temperature.

In order to achieve both high-temperature preservability and low-temperature fixability of the toner, it is particularly preferable that: the toner core has a glass transition point of at least 30° C. and no greater than 40° C.; the non-crosslinked resin forming the first domain has a glass transition point of at least 60° C. and no greater than 90° C.; and the crosslinked resin forming the second domains has a glass transition point of at least 100° C. and no greater than 150° C.

In order that the toner core, the non-crosslinked resin forming the first domain, and the crosslinked resin forming the second domains have respective appropriate glass transition points, it is particularly preferable that: the toner core contains a non-crystalline polyester resin and a crystalline polyester resin; the non-crosslinked resin is a polymer of monomers (resin raw materials) including a styrene-based monomer, a (meth)acrylic acid alkyl ester, and a (meth) acrylic acid hydroxyalkyl ester; and the crosslinked resin is a polymer of monomers (resin raw materials) including an acrylic acid-based monomer and a cross-linking agent. The acrylic acid-based monomer of the crosslinked resin is particularly preferably a (meth)acrylic acid alkyl ester that includes an alkyl group having a carbon number of at least 1 and no greater than 4 at an ester portion thereof (for example, methyl methacrylate that includes a methyl group having a carbon number of 1 at an ester portion thereof). The cross-linking agent of the crosslinked resin is particularly preferably a (meth)acrylic acid ester of alkylene glycol (for example, ethylene glycol dimethacrylate).

In order to achieve both high-temperature preservability and low-temperature fixability of the toner, the first domain preferably has an arithmetic mean height (hereinafter referred to as a first shell thickness) of at least 10 nm and less than 50 nm from the surface of the toner core, and the second domains preferably have an arithmetic mean height (hereinafter referred to as a second shell thickness) of at least 70 nm and no greater than 100 nm from the surface of the toner core. It is considered that the second domains function as spacers between toner particles to prevent agglomeration of the toner particles as a result of having a particle diameter (second shell thickness) larger than the first shell thickness.

In order to achieve both high-temperature preservability and low-temperature fixability of the toner, the first domain and the second domains are preferably layered in the stated order on the surface of the toner core to form a layered structure. The layered structure of the shell layer as above can be formed in a shell layer formation process by forming a non-crosslinked resin film having a low Tg on the surface of the toner core and then causing crosslinked resin particles having a high Tg to adhere to the surface of the toner core. In a toner particle having the layered structure in which the first domain and the second domains are layered in the stated order on the surface of the toner core, each first domain is located closer to the toner core than the second domains. That is, no second domain is located closer to the toner core than the first domain. It is thought that in a situation in which the first domain and the second domains are formed simultaneously, the non-crosslinked resin film is formed partially on the crosslinked resin particles although the non-crosslinked resin film having a low Tg more readily adheres to the toner core than the crosslinked resin particles having a high Tg. Low-temperature fixability of the toner is expected to be impaired in a configuration in which there are too many surface regions of the toner core where the crosslinked resin particles and the non-crosslinked resin film are layered in the stated order.

In order to achieve both high-temperature preservability and low-temperature fixability of the toner, it is particularly preferable that in the shell layer having the above-described layered structure (lower layer: first domain; upper layer: second domains), the first shell thickness is at least 10 nm and less than 50 nm and the second shell thickness is at least 70 nm and no greater than 100 nm.

In order to achieve both high-temperature preservability and low-temperature fixability of the toner, it is particularly preferable that: the toner core has a glass transition point of at least 30° C. and no greater than 40° C.; the non-crosslinked resin forming the first domain has a glass transition point of at least 60° C. and no greater than 90° C.; and the crosslinked resin forming the second domains has a glass transition point of at least 100° C. and no greater than 150° C.

In order to achieve both high-temperature preservability and low-temperature fixability of the toner, it is preferable that the first domain and the second domains have the same polarity. In a situation in which the first domain electrically repels the second domains, the second domains tend to be disposed in gaps in the first domain. Also, in order to increase bonding strength between the toner core and the shell layer, it is preferable that the first domain and the second domains have a polarity (for example, cationicity) opposite to a polarity (anionicity) of the toner core.

Figure 2:
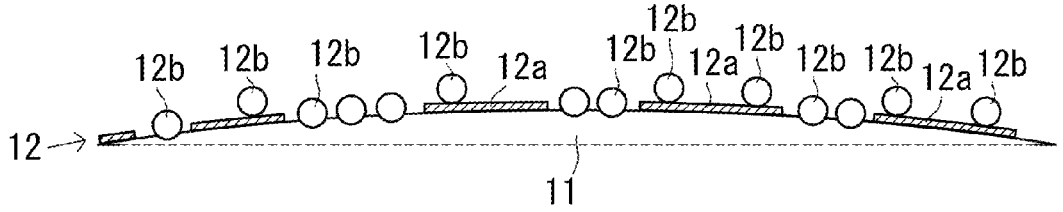
FIG. 2 is an enlarged view of a part of a surface of the toner mother particle illustrated in FIG. 1.

The following describes an example of a structure of the toner according to the present embodiment with reference to FIGS. 1 and 2. FIG. 1 is a diagram illustrating an example of a structure of a toner particle (particularly, toner mother particle) included in the toner according to the embodiment of the present disclosure. FIG. 2 is an enlarged view of a part of the toner mother particle illustrated in FIG. 1.

A toner mother particle 10 illustrated in FIG. 1 includes a toner core 11 and a shell layer 12 disposed over a surface of the toner core 11. The shell layer 12 is substantially formed from resins. The shell layer 12 covers the surface of the toner core 11.

As illustrated in FIG. 2, the shell layer 12 of the toner mother particle 10 includes film-shaped first domains 12*a* and particle-shaped second domains 12*b*. In the example illustrated in FIG. 2, the second domains 12*b* are present in surface regions of the toner core 11 where the toner core 11 is exposed from the first domains 12*a*. The second domains 12*b* are also present on the first domains 12*a*. The shell layer 12 includes a region (hereinafter referred to as a first region) constituted by the first domain 12*a* only, a region (hereinafter referred to as a second region) constituted by the second domains 12*b* only, and a region (hereinafter referred to as a third region) constituted by the first domain 12*a* and the second domains 12*b* located on the first domain 12*a*. The first domains 12*a* and the second domains 12*b* are layered in the stated order on the surface of the toner core 11 to form a layered structure. That is, the first domains 12*a* are located closer to the toner core 11 than the second domains 12*b*. The first domains 12*a* are fused with the toner core 11. Each second domain 12*b* on the toner core 11 is fixed to the toner core 11 such that a part of the second domain 12*b* is embedded in the toner core 11. Further, each second domain 12*b* on the first domain 12*a* is bonded to a surface of the first domain 12*a* mainly by Van der Waals force. The shell layer 12 includes the second domains 12*b* fixed to the surface of the toner core 11 by mechanical bonding force due to embedment and the second domains 12*b* fixed to surfaces of the first domains 12*a* mainly by Van der Waals force.

Figure 3:
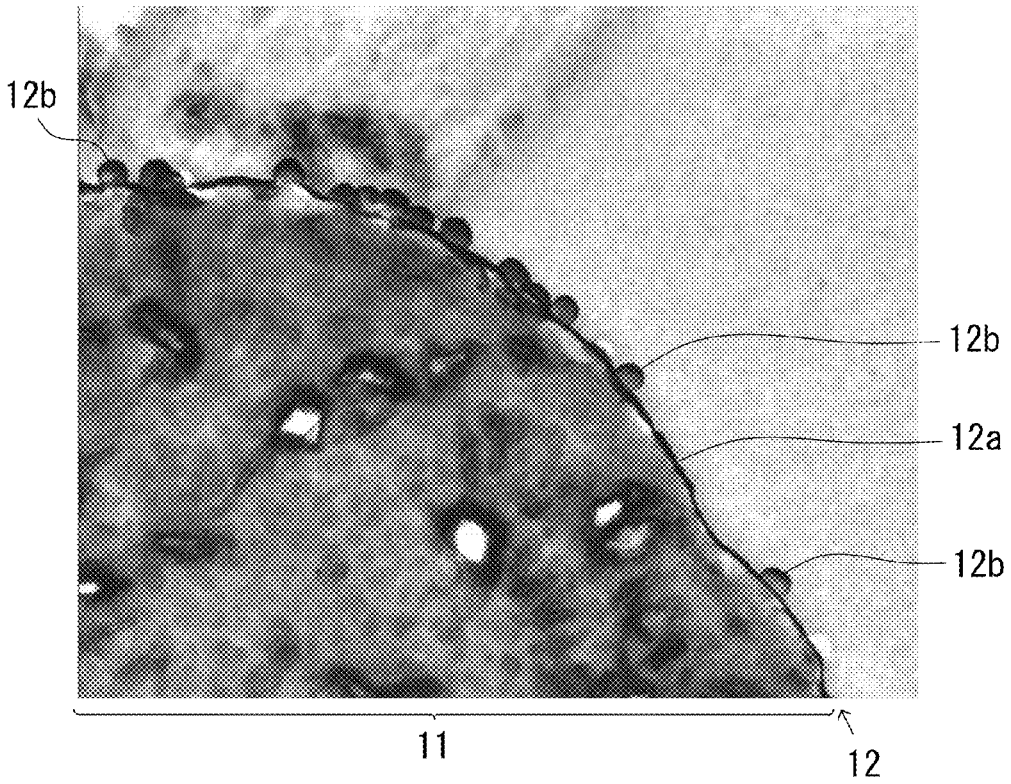
FIG. 3 is a photograph of a cross section of a toner mother particle (particularly, a cross section of a shell layer) of the toner according to the embodiment of the present disclosure, which photograph was taken using a transmission electron microscope (TEM).

A configuration of the shell layer 12 can be known for example through observation of a cross section of the toner mother particle 10 using a transmission electron microscope (TEM). FIG. 3 is a photograph of a cross section of the toner mother particle 10 (particularly, a cross section of the shell layer 12) of the toner according to the present embodiment, which photograph was taken using the TEM. The layered structure of the first domains 12*a* and the second domains 12*b* layered in the stated order on the surface of the toner core 11 can be confirmed by the photograph of FIG. 3.

In order that the toner can be suitably used for image formation, the toner preferably has a volume median diameter ($D_{50}$) of at least 4 μm and no greater than 9 μm.

Nest, the toner core (binder resin and internal additives), the shell layer, and the external additive will be described in order. Non-essential components (for example, internal additives and external additive) may be omitted depending on intended use of the toner.

<Preferable Thermoplastic Resins>

Preferable examples of thermoplastic resins include styrene-based resins, acrylic acid-based resins (specific examples include acrylic acid ester polymers and methacrylic acid ester polymers), olefin-based resins (specific examples include polyethylene resins and polypropylene resins), vinyl chloride resins, polyvinyl alcohols, vinyl ether resins, N-vinyl resins, polyester resins, polyamide resins, and urethane resins. Also, copolymers of the above-listed resins, that is, copolymers (specific examples include styrene-acrylic acid-based resins and styrene-butadiene-based resins) obtained by introducing a repeating unit into the above-listed resins may be used.

A styrene-acrylic acid-based resin is a copolymer of at least one styrene-based monomer and at least one acrylic acid-based monomer. Examples of styrene-based monomers and acrylic acid-based monomers that can be preferably used for synthesis of a styrene-acrylic acid-based resin are listed below.

Preferable examples of styrene-based monomers include styrene, α-methylstyrene, p-hydroxystyrene, m-hydroxystyrene, vinyltoluene, α-chlorostyrene, o-chlorostyrene, m-chlorostyrene, p-chlorostyrene, and p-ethylstyrene.

Preferable examples of acrylic acid-based monomers include (meth)acrylic acid, (meth)acrylic acid alkyl esters, and (meth)acrylic acid hydroxyalkyl esters. Preferable examples of (meth)acrylic acid alkyl esters include methyl (meth)acrylate, ethyl (meth)acrylate, n-propyl (meth)acrylate, iso-propyl (meth)acrylate, n-butyl (meth)acrylate, iso-butyl (meth)acrylate, and 2-ethylhexyl (meth)acrylate. Preferable examples of (meth)acrylic acid hydroxyalkyl esters include 2-hydroxyethyl (meth)acrylate, 3-hydroxypropyl (meth)acrylate, 2-hydroxypropyl (meth)acrylate, and 4-hydroxybutyl (meth)acrylate.

A polyester resin can be obtained by condensation polymerization of at least one polyhydric alcohol and at least one polybasic carboxylic acid. Examples of alcohols that can be preferably used for synthesis of a polyester resin include dihydric alcohols (specific examples include diols and bisphenols) and tri- or higher-hydric alcohols listed below. Examples of carboxylic acids that can be preferably used for synthesis of a polyester resin include dibasic carboxylic acids and tri- or higher-basic carboxylic acids listed below.

Preferable examples of diols include ethylene glycol, diethylene glycol, triethylene glycol, 1,2-propanediol, coalkanediols (specific examples include ethylene glycol, 1,3-propanediol, 1,4-butanediol, 1,5-pentanediol, 1,6-hexanediol, 1,7-heptanediol, 1,8-octanediol, 1,9-nonanediol, and 1,12-dodecanediol), 2-butene-1,4-diol, 1,4-cyclohexanedimethanol, dipropylene glycol, polyethylene glycol, polypropylene glycol, and polytetramethylene glycol.

Preferable examples of bisphenols include bisphenol A, hydrogenated bisphenol A, bisphenol A ethylene oxide adducts, and bisphenol A propylene oxide adducts.

Preferable examples of tri- or higher-hydric alcohols include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Preferable examples of dibasic carboxylic acids include aromatic dicarboxylic acids (specific examples include phthalic acid, terephthalic acid, and isophthalic acid), α,ω-alkane dicarboxylic acids (specific examples include malonic acid, succinic acid, adipic acid, suberic acid, azelaic acid, sebacic acid, and 1,10-decanedicarboxylic acid), alkyl succinic acids (specific examples include n-butylsuccinic acid, isobutylsuccinic acid, n-octylsuccinic acid, n-dodecylsuccinic acid, and isododecylsuccinic acid), alkenyl succinic acids (specific examples include n-butenylsuccinic acid, isobutenylsuccinic acid, n-octenylsuccinic acid, n-dodecenylsuccinic acid, and isododecenylsuccinic acid), unsaturated dicarboxylic acids (specific examples include maleic acid, fumaric acid, citraconic acid, itaconic acid and glutaconic acid), and cycloalkanedicarboxylic acids (specific examples include cyclohexanedicarboxylic acid).

Preferable examples of tri- or higher-basic carboxylic acids include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and EMPOL trimer acid.

[Toner Core]

(Binder Resin)

The binder resin is typically a main component (for example, at least 85% by mass) of the toner core. Properties of the binder resin are therefore thought to have a great influence on properties of the toner core as a whole. In a situation in which the binder resin has an ester group, a hydroxyl group, an ether group, an acid group, or a methyl group, the toner core is highly likely to be anionic. In a situation in which the binder resin has an amino group or an amide group, the toner core is highly likely to be cationic. In order to increase reactivity between the toner core and the shell layer, it is preferable that at least one of a hydroxyl value and an acid value of the binder resin is at least 10 mgKOH/g.

Resin that have at least one group selected from the group consisting of an ester group, a hydroxyl group, an ether group, an acid group, and a methyl group are preferably used as the binder resin. Resins that have a hydroxyl group and/or a carboxyl group are more preferably used as the binder resin. Resins that have a functional group including active hydrogen in molecules thereof are also preferably used as the binder resin.

Thermoplastic resins (specific examples include the "Preferable Thermoplastic Resins" listed above) are preferably used as the binder resin of the toner core. In order to improve dispersibility of a colorant in the toner core, chargeability of the toner, and fixability of the toner to a recording medium, a styrene-acrylic acid-based resin or a polyester resin is particularly preferably used as the binder resin.

In a situation in which a styrene-acrylic acid-based resin is used as the binder resin of the toner core, the styrene-acrylic acid-based resin preferably has a number average molecular weight (Mn) of at least 2000 and no greater than 3000 in order to improve strength of the toner core and fixability of the toner. The styrene-acrylic acid-based resin preferably has molecular weight distribution (a ratio (Mw/

Mn) of a mass average molecular weight (Mw) to the number average molecular weight (Mn)) of at least 10 and no greater than 20.

In a situation in which a polyester resin is used as the binder resin of the toner core, the polyester resin preferably has a number average molecular weight (Mn) of at least 1000 and no greater than 2000 in order to improve strength of the toner core and fixability of the toner. The polyester resin preferably has molecular weight distribution (a ratio (Mw/Mn) of a mass average molecular weight (Mw) to the number average molecular weight (Mn)) of at least 9 and no greater than 21.

In order to obtain a toner excellent in high-temperature preservability and low-temperature fixability, the toner core preferably contains a crystalline polyester resin in addition to a non-crystalline polyester resin.

Preferable examples of crystalline polyester resins include a polymer of monomers (resin raw materials) including at least one α,ω-alkanediol having a carbon number of at least 2 and no greater than 12 (for example, two α,ω-alkanediols: 1,4-butanediol having a carbon number of 4 and 1,6-hexanediol having a carbon number of 6), at least one α,ω-alkane dicarboxylic acid having a carbon number (specifically, carbon number including the number of carbon atoms included in two carboxyl groups) of at least 4 and no greater than 10 (for example, succinic acid having a carbon number of 4), at least one styrene-based monomer (for example, styrene), and at least one acrylic acid-based monomer (for example, acrylic acid).

In order that the toner core has a desired degree of sharp meltability, the toner core preferably contains a crystalline polyester resin having a crystallinity index of at least 0.90 and no greater than 1.20. A crystallinity index of a resin corresponds to a ratio (=Tm/Mp) of a softening point (Tm) of the resin to a melting point (Mp) of the resin. Definite Mp of a non-crystalline polyester resin is often unmeasurable. Mp and Tm of a resin are measured by the same methods as those used in the examples described further below or any suitable alternative method. A crystallinity index of a crystalline polyester resin can be adjusted by changing a material used in synthesis of the crystalline polyester resin or an amount of use (blend ratio) of the material. The toner core may contain only one crystalline polyester resin or two or more crystalline polyester resins.

In order to achieve both high-temperature preservability and low-temperature fixability of the toner, the toner core preferably contains, as the binder resin, a plurality of non-crystalline polyester resins having softening points (Tm) different from each other, and particularly preferably contains a non-crystalline polyester resin having a softening point of at least 60° C. and no greater than 90° C., a non-crystalline polyester resin having a softening point of at least 100° C. and no greater than 120° C., and a non-crystalline polyester resin having a softening point of at least 125° C. and no greater than 150° C.

Preferable examples of non-crystalline polyester resins having a softening point of at least 60° C. and no greater than 90° C. include a non-crystalline polyester resin that contains at least one bisphenol (for example, a bisphenol A ethylene oxide adduct and/or a bisphenol A propylene oxide adduct) as an alcoholic component and an aromatic dicarboxylic acid (for example, terephthalic acid) and an unsaturated dicarboxylic acid (for example, fumaric acid) as acid components.

Preferable examples of non-crystalline polyester resins having a softening point of at least 100° C. and no greater than 120° C. include a non-crystalline polyester resin that contains at least one bisphenol (for example, a bisphenol A ethylene oxide adduct and/or a bisphenol A propylene oxide adduct) as an alcoholic component and an aromatic dicarboxylic acid (for example, terephthalic acid) as an acid component, and does not contain an unsaturated dicarboxylic acid.

Preferable examples of non-crystalline polyester resins having a softening point of at least 125° C. and no greater than 150° C. include a non-crystalline polyester resin that contains at least one bisphenol (for example, a bisphenol A ethylene oxide adduct and/or a bisphenol A propylene oxide adduct) as an alcoholic component and a dicarboxylic acid that includes an alkyl group having a carbon number of at least 10 and no greater than 20 (for example, dodecyl succinic acid that includes an alkyl group having a carbon number of 12), an unsaturated dicarboxylic acid (for example, fumaric acid), and a tribasic carboxylic acid (for example, trimellitic acid) as acid components.

Typically, toner cores are broadly classified into pulverized cores (also called a pulverized toner) and polymerized cores (also called a chemical toner). Toner cores obtained by a pulverization method belong to the pulverized cores and toner cores obtained by an aggregation method belong to the polymerized cores. Toner cores of the toner having the above-described basic features are preferably pulverized cores containing a polyester resin.

(Colorant)

The toner core may contain a colorant. A known pigment or dye that matches the color of the toner may be used as the colorant. In order to form a high-quality image using the toner, an amount of the colorant is preferably at least 1 part by mass and no greater than 20 parts by mass relative to 100 parts by mass of the binder resin.

The toner core may contain a black colorant. An example of the black colorant is carbon black. Alternatively, the black colorant may be a colorant that is adjusted to a black color using a yellow colorant, a magenta colorant, and a cyan colorant.

The toner core may contain a non-black colorant such as a yellow colorant, a magenta colorant, or a cyan colorant.

One or more compounds selected from the group consisting of condensed azo compounds, isoindolinone compounds, anthraquinone compounds, azo metal complexes, methine compounds, and arylamide compounds can for example be used as the yellow colorant. Examples of yellow colorants that can be preferably used include C. I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, and 194), Naphthol Yellow S, Hansa Yellow G, and C.I. Vat Yellow.

One or more compounds selected from the group consisting of condensed azo compounds, diketopyrrolopyrrole compounds, anthraquinone compounds, quinacridone compounds, basic dye lake compounds, naphthol compounds, benzimidazolone compounds, thioindigo compounds, and perylene compounds can for example be used as the magenta colorant. Examples of magenta colorants that can be preferably used include C. I. Pigment Red (2, 3, 5, 6, 7, 19, 23, 48:2, 48:3, 48:4, 57:1, 81:1, 122, 144, 146, 150, 166, 169, 177, 184, 185, 202, 206, 220, 221, and 254).

One or more compounds selected from the group consisting of copper phthalocyanine compounds, anthraquinone compounds, and basic dye lake compounds can for example be used as the cyan colorant. Examples of cyan colorants that can be preferably used include C. I. Pigment Blue (1, 7, 15, 15:1, 15:2, 15:3, 15:4, 60, 62, and 66), Phthalocyanine Blue, C.I. Vat Blue, and C.I. Acid Blue.

(Releasing Agent)

The toner core may contain a releasing agent. The releasing agent is used for example in order to improve fixability of the toner or resistance of the toner to being offset. In order to improve anionic strength of the toner core, the toner core is preferably prepared using an anionic wax. In order to improve fixability of the toner or resistance of the toner to being offset, an amount of the releasing agent is preferably at least 1 part by mass and no greater than 30 parts by mass relative to 100 parts by mass of the binder resin.

Examples of releasing agents that can be preferably used include: aliphatic hydrocarbon waxes such as low molecular weight polyethylene, low molecular weight polypropylene, polyolefin copolymer, polyolefin wax, microcrystalline wax, paraffin wax, and Fischer-Tropsch wax; oxides of aliphatic hydrocarbon waxes such as polyethylene oxide wax and block copolymer of polyethylene oxide wax; plant waxes such as candelilla wax, carnauba wax, Japan wax, jojoba wax, and rice wax; animal waxes such as beeswax, lanolin, and spermaceti; mineral waxes such as ozokerite, ceresin, and petrolatum; waxes having a fatty acid ester as a main component such as montanic acid ester wax and castor wax: and waxes in which a part or all of a fatty acid ester has been deoxidized such as deoxidized carnauba wax. A releasing agent may be used alone, or two or more releasing agents may be used in combination.

A compatibilizer may be added to the toner core in order to improve compatibility between the binder resin and the releasing agent.

(Charge Control Agent)

The toner core may contain a charge control agent. The charge control agent is used for example in order to improve charge stability or a charge rise characteristic of the toner. The charge rise characteristic of the toner is an indicator as to whether or not the toner can be charged to a specific charge level in a short period of time.

Anionic strength of the toner core can be increased by including a negatively chargeable charge control agent (specific examples include organic metal complexes and chelate compounds) in the toner core. Cationic strength of the toner core can be increased by including a positively chargeable charge control agent (specific examples include pyridine, nigrosine, and quaternary ammonium salts) in the toner core. However, the toner core need not contain a charge control agent so long as sufficient chargeability of the toner can be achieved without use of the charge control agent.

(Magnetic Powder)

The toner core may contain a magnetic powder. Examples of materials of the magnetic powder that can be preferably used include ferromagnetic metals (specific examples include iron, cobalt, nickel, and an alloy containing one or more of the listed metals), ferromagnetic metal oxides (specific examples include ferrite, magnetite, and chromium dioxide), and materials subjected to ferromagnetization (specific examples include carbon materials to which ferromagnetism is imparted through thermal treatment). A magnetic powder may be used alone, or two or more magnetic powders may be used in combination.

The magnetic powder is preferably subjected to surface treatment in order to inhibit elution of metal ions (for example, iron ions) from the magnetic powder. In a situation in which the shell layer is formed on the surface of each toner core under acidic conditions, elution of metal ions to the surfaces of the toner cores tends to cause adhesion of the toner cores to one another. It is expected that adhesion of the toner cores to one another can be inhibited by inhibiting elution of metal ions from the magnetic powder.

[Shell Layer]

The toner according to the present embodiment has the above-described basic features. The shell layer includes the film-shaped first domain and the particle-shaped second domains. The first domain is substantially formed from a non-crosslinked resin. The second domains are substantially formed from a crosslinked resin.

In order to achieve both high-temperature preservability and low-temperature fixability of the toner, the non-crosslinked resin forming the first domain is preferably a non-crosslinked thermoplastic resin (specific examples include the "Preferable Thermoplastic Resins" listed above). In order to achieve sufficient chargeability of the toner, the non-crosslinked resin forming the first domain is particularly preferably a polymer of monomers (resin raw materials) including a styrene-based monomer (specific examples include styrene), a (meth)acrylic acid alkyl ester (specific examples include ethyl acrylate), and a (meth)acrylic acid hydroxyalkyl ester (specific examples include 2-hydroxybutyl acrylate). Note that a vinyl compound is a compound having a vinyl group ($CH_2$═CH—) or a group obtained through substitution of hydrogen in a vinyl group. Examples of vinyl compounds include ethylene, propylene, butadiene, vinyl chloride, acrylic acid, acrylic acid ester, methacrylic acid, methacrylic acid ester, acrylonitrile, and styrene. The vinyl compound can be a macromolecule (resin) through addition polymerization by double bonding "C═C" included in the vinyl group or the like.

In order to achieve both high-temperature preservability and low-temperature fixability of the toner, the crosslinked resin forming the second domains is preferably a thermoplastic resin (specific examples include the "Preferable Thermoplastic Resins" listed above) having a cross-linking structure. In order to achieve sufficient chargeability of the toner, the crosslinked resin forming the second domains is particularly preferably a polymer of monomers (resin raw materials) including an acrylic acid-based monomer and a cross-linking agent. A (meth)acrylic acid ester of alkylene glycol (specific examples include ethylene glycol dimethacrylate) is particularly preferably used as the cross-linking agent for introducing a cross-linking structure to an acrylic acid-based resin.

In order to increase positive chargeability of the toner, the shell layer preferably contains a cationic surfactant. By leaving a cationic surfactant used for forming the shell layer rather than removing the cationic surfactant, the cationic surfactant can be included in the shell layer. The cationic surfactant included in the shell layer is preferably an amine salt (specific examples include an acetic acid salt of primary amine) or a quatemary ammonium salt (specific examples include an alkyl trimethyl ammonium salt, a dialkyl dimethyl ammonium salt, an alkyl benzyl dimethyl ammonium salt, an acryloyloxyalkyl trimethyl ammonium salt, a methacryloyloxy alkyl trimethyl ammonium salt, and benzethonium chloride).

[External Additive]

An external additive (specifically, powder including a plurality of external additive particles) may be caused to adhere to a surface of each toner mother particle. Unlike internal additives, the external additive is not present within the toner mother particles and is selectively present on the surfaces of the toner mother particles (surfaces of the toner particles). The external additive particles can be caused to adhere to the surface of each toner mother particle for example by stirring the toner mother particles (powder) and the external additive (powder) together. The toner mother particles do not chemically react with the external additive particles. The toner mother particles and the external additive particles bond together physically not chemically. Bonding strength between the toner mother particles and the external additive particles can be adjusted by controlling conditions of stirring (more specifically, a stirring time, a rotational speed for stirring, and the like) and particle diameter, shape, and surface conditions of the external additive particles.

In order for the external additive to sufficiently exhibit its function while preventing separation of the external additive from the toner particles, an amount of the external additive (in a situation in which two or more external additives are used, a total amount of the external additives) is preferably at least 0.5 parts by mass and no greater than 10 parts by mass relative to 100 parts by mass of the toner mother particles. In order to improve fluidity or handleability of the toner, inorganic particles having a particle diameter of at least 0.005 μm and no greater than 1.000 μm are preferably used as the external additive particles.

The external additive particles are preferably inorganic particles, and particularly preferably silica particles or particles of metal oxides (specific examples include alumina, titanium oxide, magnesium oxide, zinc oxide, strontium titanate, and barium titanate). An external additive may be used alone, or two or more external additives may be used in combination.

In order to achieve sufficient chargeability of the toner, it is particularly preferable that silica particles and titanium oxide particles (both being external additives) adhere to the surface of each toner mother particle.

[Method for Producing Toner]

In order to produce an electrostatic latent image developing toner that hardly contaminates a carrier and that is excellent in high-temperature preservability and low-temperature fixability, a method for producing the toner preferably includes a first shell layer formation process and a second shell layer formation process.

In the first shell layer formation process, a non-crosslinked resin film is formed by a wet method on the surface of each toner core at coverage of at least 45% and no greater than 80%. This coverage corresponds to the above-described "first coverage". In the second shell layer formation process, crosslinked resin particles and toner cores with the non-crosslinked resin film formed thereon are mixed together by a dry method at a temperature of at least 32° C. and no greater than 37° C. to cause the crosslinked resin particles to adhere to the surfaces of the toner cores and surfaces of the non-crosslinked resin films.

(Production of Toner Cores)

In order to obtain favorable toner cores easily, the toner cores are preferably produced by the aggregation method or the pulverization method, and more preferably produced by the pulverization method.

The following describes an example of the pulverization method. Initially, a binder resin and at least one internal additive (for example, at least one of a colorant, a releasing agent, a charge control agent, and a magnetic powder) are mixed together. Subsequently, the resultant mixture is melt-kneaded. Subsequently, the resultant melt-kneaded product is pulverized, and the pulverized product is classified. As a result, toner cores having a desired particle diameter are obtained.

The following describes an example of the aggregation method. Initially, a binder resin, a releasing agent, and a colorant each in the form of particulates are caused to aggregate in an aqueous medium to form particles having a desired particle diameter. Through the above, aggregated particles containing components of the binder resin, the releasing agent, and the colorant are formed. Subsequently, the obtained aggregated particles are heated to cause coalescence of the components contained in the aggregated particles. As a result, a dispersion of toner cores is obtained. Thereafter, unnecessary substances (surfactant and the like) are removed from the dispersion of the toner cores to obtain the toner cores.

(Formation of Shell Layer)

Next, the shell layer is formed on the surface of each toner core obtained as above. Initially, a weakly acidic (for example, pH of 3 to 5) aqueous medium is prepared by adding a hydrochloric acid to ion exchanged water. Then, the toner cores and a first shell material (specifically, material for the first domain) are added to the aqueous medium having the adjusted pH (for example, acidic aqueous medium). A suspension of a non-crosslinked resin (that is, a liquid containing non-crosslinked resin particles) can for example be used as the first shell material.

In order to form a homogeneous first domain, it is preferable to dissolve or disperse the first shell material in a liquid for example by stirring the liquid containing the first shell material. In order to inhibit dissolution or elution of components of the toner cores (particularly, the binder resin and the releasing agent) during formation of the first domain, the first domain is preferably formed in an aqueous medium. The aqueous medium is a medium that contains water as a major component (specific examples include pure water and a liquid mixture of water and a polar medium). The aqueous medium may function as a solvent. A solute may be dissolved in the aqueous medium. The aqueous medium may function as a dispersion medium. A dispersoid may be dispersed in the aqueous medium. Alcohols (specific examples include methanol and ethanol) can be used as the polar medium in the aqueous medium. The aqueous medium has a boiling point of approximately 100° C.

The toner cores and the first shell material described above may be added to an aqueous medium at room temperature or an aqueous medium at a specific temperature adjusted in advance. The first coverage can be adjusted for example by changing an amount of addition of the first shell material. An appropriate amount of addition of the first shell material can be calculated based on a specific surface area of the toner cores.

The non-crosslinked resin particles adhere to the surface of each toner core in a liquid. In order to cause the non-crosslinked resin particles to adhere uniformly to the surface of each toner core, it is preferable to achieve a high degree of dispersion of the toner cores in the liquid containing the non-crosslinked resin particles. In order to achieve a high degree of dispersion of the toner cores in the liquid, a surfactant may be added to the liquid or the liquid may be stirred using a powerful stirrer (for example, "Hivis Disper Mix" manufactured by PRIMIX Corporation). Examples of surfactants that can be used include sulfate ester salt surfactants, sulfonic acid salt surfactants, phosphate ester salt surfactants, and soaps.

Subsequently, a temperature of the liquid containing the toner cores and the non-crosslinked resin particles described above is increased to a first retention temperature (preferably, a temperature that satisfies the following relationship "(Tg of non-crosslinked resin)−10° C.≤first retention temperature≤(Tg of non-crosslinked resin)+20° C.)" at a predetermined rate (for example, at least 0.1° C./minute and no greater than 3° C./minute) while stirring the liquid. In the following description, this temperature increasing treatment may be referred to as "first temperature increasing treatment". After the first temperature increasing treatment (after the temperature of the liquid reached the first retention temperature), the temperature of the liquid may be maintained at the first retention temperature for a predetermined time period (for example, at least 1 minute and no longer than 60 minutes) while stirring the liquid. During the first temperature increasing treatment (that is, while the temperature of the liquid is being increased to the first retention temperature) or while the temperature of the liquid is being maintained at the first retention temperature after the first temperature increasing treatment, the non-crosslinked resin particles melt (deform) to form the first domain (specifically, non-crosslinked resin film) on the surface of each toner core. Further, the first domain is thought to fuse with the toner core as a result of melting of the surface (for example, the binder resin) of each toner core. As a result of formation of the first domain on the surface of each toner core, toner cores with the first domain formed thereon are obtained. In the following description, the toner cores on which the first domain is formed and the second domains are not formed will be referred to as "first covered cores". A state of melting of the non-crosslinked resin particles can be adjusted by adjusting the first retention temperature and Tg of the non-crosslinked resin. A film without granular appearance can for example be formed by completely melting the resin particles.

After the first domain is formed as above, the dispersion of the first covered cores is cooled for example to room temperature (approximately 25° C.). Subsequently, the dispersion of the first covered cores is filtered for example using a Buchner funnel. Through the above, the first covered cores are separated from the liquid (solid-liquid separation) to collect a wet cake of the first covered cores. Subsequently, the collected wet cake of the first covered cores is washed. The washed first covered cores are then dried.

Subsequently, the dry first covered cores (powder) and a second shell material (specifically, material for the second domains) are mixed together using a mixer in an environment maintained at a predetermined second retention temperature (preferably, at least 32° C. and no greater than 3° C.). Crosslinked resin particles (powder) can for example be used as the second shell material. The crosslinked resin particles are caused to adhere to surfaces of the first covered cores (specifically, the toner cores with the first domain formed thereon), whereby the first domain (specifically, the non-crosslinked resin film) and the second domains (specifically, the crosslinked resin particles) are layered in the stated order. As a result, the shell layer having the layered structure (lower layer: first domain; upper layer: second domains) is formed on the surface of each toner core to yield toner mother particles. The second domains are present on the surface of each toner core and a surface of each first domain. Each second domain on the surface of the toner core is fixed to the toner core such that a part of the second domain is embedded in the toner core. Also, each second domain on the first domain is thought to be bonded to the surface of the first domain mainly by Van der Waals force.

An FM mixer (product of Nippon Coke & Engineering Co., Ltd.) can for example be used as the above-described mixer. The FM mixer includes a mixing vessel equipped with a temperature control jacket. The FM mixer further includes a deflector, a temperature sensor, an upper screw: and a lower screw, which are provided in the mixing vessel. When materials (more specifically, powders or slurry) loaded into the mixing vessel of the FM mixer are mixed, the materials in the mixing vessel are caused to flow in an up-and-down direction while swirling by rotation of the lower screw. As a result, a convective flow of the materials is generated in the mixing vessel. Shear force is applied to the materials by the upper screw rotating at a high speed. The FM mixer is capable of mixing the materials with strong mixing force by applying the shear force to the materials. Mixing can be performed at a temperature of at least 32° C. and no greater than 37° C. by circulating water at a temperature of at least 32° C. and no greater than 37° C. through the jacket of the FM mixer. In order to form a high-quality shell layer on the surface of each toner core, it is preferable that: the toner core has a glass transition point of at least 30° C. and no greater than 40° C.; the first shell material (specifically, the non-crosslinked resin particles) has a glass transition point of at least 60° C. and no greater than 90° C.; and the second shell material (specifically, the crosslinked resin particles) has a glass transition point of at least 100° C. and no greater than 150° C.

After the toner mother particles are obtained as above, an external additive may be caused to adhere to surfaces of the toner mother particles as necessary by mixing the toner mother particles and the external additive using a mixer (for example, an FM mixer manufactured by Nippon Coke & Engineering Co., Ltd.). Note that in a situation in which a spray dryer is used in the drying process, the drying process and an external addition process can be performed simultaneously by spraying a dispersion of the external additive (for example, silica particles) to the toner mother particles. Through the above, a toner including a larger number of toner particles is obtained.

The above-described method for producing the toner may be altered as appropriate in accordance with requirements of the toner, such as in terms of the structure and properties. For example, the toner may be sifted after the external addition process. Also, non-essential processes may be omitted. For example, in a situation in which a commercially available product can be used directly as a material, use of the commercially available product can omit the process for preparing the material. In a situation in which reaction for forming the shell layer progresses favorably even without pH adjustment of the liquid, a process of pH adjustment may be omitted. In a situation in which an external additive is unnecessary, the external addition process may be omitted. In a situation in which an external additive is not caused to adhere to the surfaces of the toner mother particles (the external addition process is omitted), the toner mother particles are equivalent to the toner particles. A prepolymer may be used as necessary instead of a monomer as a material for synthesizing a resin. In order to obtain a specific compound, a salt, ester, hydrate, or anhydride of the compound may be used as a raw material. Preferably, a large number of toner particles are formed at the same time in order to produce the toner efficiently. The toner particles produced at the same time are thought to have substantially the same structure.

EXAMPLES

The following describes examples of the present disclosure. Table 1 shows toners T-1 to T-11 (electrostatic latent image developing toners) according to examples and comparative examples. Table 2 shows shell materials (suspensions A-1 to A-5 and resin particles B-1 to B-3) used for producing any of the toners T-1 to T-11.

TABLE 1

| Toner | Shell material First | Shell material Second | Shell layer Tg difference [° C.] | First domain Coverage [%] | Second domain Formation temperature [° C.] | Second domain Multiple coverage [% by number] |
|---|---|---|---|---|---|---|
| T-1 | A-1 | B-1 | 46 (=114 − 68) | 80 | 34.5 | 70 |
| T-2 | A-1 | B-3 | 62 (=130 − 68) | 70 | 34.5 | 60 |
| T-3 | A-2 | B-2 | 49 (=122 − 73) | 65 | 34.5 | 52 |
| T-4 | A-3 | B-2 | 40 (=122 − 82) | 54 | 34.5 | 35 |
| T-5 | A-3 | B-3 | 48 (=130 − 82) | 50 | 34.5 | 30 |
| T-6 | A-1 | B-2 | 54 (=122 − 68) | 77 | 34.5 | 61 |
| T-7 | A-5 | B-2 | 38 (=122 − 84) | 48 | 34.5 | 25 |
| T-8 | A-4 | B-2 | 57 (=122 − 65) | 86 | 34.5 | 77 |
| T-9 | A-1 | B-1 | 46 (=114 − 68) | 77 | 28.5 | 75 |
| T-10 | A-1 | B-1 | 46 (=114 − 68) | 70 | 39.5 | — |
| T-11 | A-1 | — | — | 60 | — | — |

In Table 1, "First" and "Second" of the shell material indicate a first shell material and a second shell material, respectively. In Table 1, "Tg difference" of the shell layer indicates a value (unit: C) obtained by subtracting a glass transition point of a non-crosslinked resin forming the first domain from a glass transition point of a crosslinked resin forming the second domains.

In Table 1, "Coverage" of the first domain indicates first coverage (specifically, proportion of a total length of at least one surface region of a toner core covered by the at least one first domain relative to a circumferential length of the toner core determined in a cross-sectional image of a toner particle).

In Table 1, "Multiple coverage" of the second domain indicates a proportion of multiple covering (specifically, proportion of the number of second domains adhering to a surface of the at least one first domain relative to the number of all second domains included in a toner particle determined in a cross-sectional image of the toner particle).

In Table 1, "Formation temperature" of the second domain indicates a middle temperature (±2.5° C.) of water circulated through a jacket of an FM mixer in a second shell layer formation process and an external addition process.

TABLE 2

| Shell material | Cross-linking | Tg [° C.] | Particle diameter [nm] |
|---|---|---|---|
| A-1 | Absent | 68 | 53 |
| A-2 | | 73 | 55 |
| A-3 | | 82 | 52 |
| A-4 | | 65 | 53 |
| A-5 | | 84 | 56 |
| B-1 | Present | 114 | 84 |
| B-2 | | 122 | 84 |
| B-3 | | 130 | 90 |

In Table 2, "Particle diameter" indicates a number average value (unit: nm) of equivalent circular diameters of primary particles measured for each of the first shell materials (specifically, suspensions A-1 to A-5) and the second shell materials (specifically, resin particles B-1 to B-3) using a scanning electron microscope (SEM).

The following describes production methods, evaluation methods, and evaluation results of the toners T-1 to T-11 in order. In evaluations in which errors may occur, an evaluation value was calculated by calculating an arithmetic mean of an appropriate number of measured values to ensure that any errors were sufficiently small. A glass transition point (Tg), a melting point (Mp), and a softening point (Tm) were measured by respective methods described below, unless otherwise stated.

<Tg Measuring Method>

A differential scanning calorimeter ("DSC-6220" manufactured by Seiko Instruments Inc.) was used as a measuring device. A glass transition point (Tg) of a sample was determined by plotting a heat absorption curve of the sample using the measuring device. Specifically, about 10 mg of the sample (for example, a resin) was put in an aluminum pan (aluminum container) and the aluminum pan was set in a measurement section of the measuring device. Also, an empty aluminum pan was used as a reference. In plotting the heat absorption curve, a temperature of the measurement section was increased from a measurement starting temperature of 25° C. to 200° C. at a rate of 10° C./minute (RUN 1). Thereafter, the temperature of the measurement section was decreased from 200° C. to 25° C. at a rate of 10° C./minute. Subsequently, the temperature of the measurement section was increased again from 25° C. to 200° C. at a rate of 10° C./minute (RUN 2). The heat absorption curve (vertical axis: heat flow (DSC signals); horizontal axis: temperature) was plotted in RUN 2. Tg (glass transition point) of the sample was read from the plotted heat absorption curve. A temperature (onset temperature) at a point of change in the specific heat (intersection between an extrapolation line of a base line and an extrapolation line of a fall line) on the heat absorption curve corresponds to Tg of the sample.

<Tm Measuring Method>

An S-shaped curve (horizontal axis: temperature: vertical axis: stroke) of a sample (for example, a resin) was plotted by setting the sample in a capillary rheometer ("CFT-500D" manufactured by Shimadzu Corporation) and causing melt-flow of 1 $cm^3$ of the sample under conditions of a die pore diameter of 1 mm, a plunger load of 20 $kg/cm^2$, and a heating rate of 6° C./minute. Tm (softening point) of the sample was read from the plotted S-shaped curve. Tm of the sample is a temperature on the S-shaped curve corresponding to a stroke value of $(S_1+S_2)/2$ where $S_1$ represents a maximum value of the stroke and $S_2$ represents a base-line stroke value at low temperatures.

<Mp Measuring Method>

A differential scanning calorimeter ("DSC-6220" manufactured by Seiko Instruments Inc.) was used as a measuring device. Mp (melting point) of a sample was determined by plotting a heat absorption curve of the sample using the measuring device. Specifically, about 15 mg of the sample (for example, a releasing agent or a resin) was put in an aluminum pan (aluminum container) and the aluminum pan was set in a measurement section of the measuring device. Also, an empty aluminum pan was used as a reference. In plotting the heat absorption curve, a temperature of the measurement section was increased from a measurement starting temperature of 30° C. to 170° C. at a rate of 10° C./minute. The heat absorption curve (vertical axis: heat flow (DSC signals); horizontal axis: temperature) of the sample was plotted while increasing the temperature. Mp (melting point) of the sample was read from the plotted heat absorption curve. A temperature of a heat absorption peak (that is, a temperature corresponding to a maximum endothermic energy amount) derived from heat of fusion on the heat absorption curve corresponds to Mp of the sample.

[Preparation of Materials]

(Synthesis of Crystalline Polyester Resin)

A 10-L four-necked flask equipped with a thermometer (thermocouple), a dewatering conduit, a nitrogen inlet tube, and a stirrer was charged with 2643 g of 1,6-hexanediol, 864 g of 1,4-butanediol, and 2945 g of succinic acid. A temperature of the flask contents was then increased to 160° C. to melt the flask contents. Subsequently, a liquid mixture of styrene and the like (liquid mixture of 1831 g of styrene, 161 g of acrylic acid, and 110 g of dicumyl peroxide) was dripped into the flask over one hour using a dripping funnel. Subsequently, the flask contents were caused to react for one hour at a temperature of 170° C. while being stirred to polymerize styrene and acrylic acid in the flask. Thereafter, unreacted styrene and unreacted acrylic acid in the flask were removed by keeping the flask contents in a depressurized atmosphere (pressure: 8.3 kPa) for one hour. Subsequently, 40 g of tin(II) 2-ethylhexanoate and 3 g of gallic acid were added into the flask. Subsequently, the flask contents were heated and caused to react for eight hours at a temperature of 210° C. Subsequently, the flask contents were caused to react for one hour at the temperature of 210° C. in a depressurized atmosphere (pressure: 8.3 kPa). As a result, a crystalline polyester resin having Tm of 92° C., Mp of 96° C., and a crystallinity index of 0.95 was obtained. Note that a crystallinity index of a resin corresponds to a ratio (=Tm/Mp) of a softening point (Tm) of the resin to a melting point (Mp) of the resin.

(Synthesis of Non-Crystalline Polyester Resin A)

A 10-L four-necked flask equipped with a thermometer (thermocouple), a dewatering conduit, a nitrogen inlet tube, and a stirrer was charged with 370 g of a bisphenol A propylene oxide adduct, 3059 g of a bisphenol A ethylene oxide adduct, 1194 g of terephthalic acid, 286 g of fumaric acid, 10 g of tin(II) 2-ethylhexanoate, and 2 g of gallic acid. The flask contents were caused to react in a nitrogen atmosphere at a temperature of 230° C. until a reaction percentage reached at least 90% by mass. The reaction percentage was calculated according to an expression "reaction percentage=100×(actual amount of water generated by the reaction)/(theoretical amount of water generated by the reaction)". Subsequently, the flask contents were caused to react in a depressurized atmosphere (pressure: 8.3 kPa) until Tm of a reaction product (resin) reached a predetermined temperature (89° C.). As a result, a non-crystalline polyester resin A having Tm of 89° C. and Tg of 50° C. was obtained.

(Synthesis of Non-Crystalline Polyester Resin B)

A non-crystalline polyester resin B was synthesized according to the same method as for the non-crystalline polyester resin A in all aspects other than that 1286 g of a bisphenol A propylene oxide adduct, 2218 g of a bisphenol A ethylene oxide adduct, and 1603 g of terephthalic acid were used in place of 370 g of a bisphenol A propylene oxide adduct, 3059 g of a bisphenol A ethylene oxide adduct, 1194 g of terephthalic acid, and 286 g of fumaric acid. The non-crystalline polyester resin B had Tm of 111° C. and Tg of 69° C.

(Synthesis of Non-crystalline Polyester Resin C)

A 10-L four-necked flask equipped with a thermometer (thermocouple), a dewatering conduit, a nitrogen inlet tube, and a stirrer was charged with 4907 g of a bisphenol A propylene oxide adduct, 1942 g of a bisphenol A ethylene oxide adduct, 757 g of fumaric acid, 2078 g of dodecylsuccinic acid anhydride, 30 g of tin(II) 2-ethylhexanoate, and 2 g of gallic acid. The flask contents were caused to react in a nitrogen atmosphere at a temperature of 230° C. until a reaction percentage represented by the above expression reached at least 90% by mass. Subsequently, the flask contents were caused to react for one hour in a depressurized atmosphere (pressure: 8.3 kPa). Subsequently, 548 g of trimellitic acid anhydride was added into the flask and the flask contents were caused to react in the depressurized atmosphere (pressure: 8.3 kPa) at a temperature of 220° C. until Tm of a reaction product (resin) reached a predetermined temperature (127° C.). As a result, a non-crystalline polyester resin C having Tm of 127° C. and Tg of 51° C. was obtained.

(Preparation of Suspension A-1)

A 1-L three-necked flask equipped with a thermometer and a stirring impeller was set in a water bath at a temperature of 30° C. and the flask was charged with 875 mL of ion exchanged water and 75 mL of a cationic surfactant ("Texnol (registered Japanese trademark) R5" manufactured by NIPPON NYUKAZAI CO., LTD., component: alkyl benzyl dimethyl ammonium salt). Thereafter, a temperature inside the flask was increased to 80° C. using the water bath. Subsequently, two liquids (first liquid and second liquid) were each dripped into the flask contents at the temperature of 80° C. over five hours. The first liquid was a liquid mixture of 12 mL of styrene, 4 mL of 2-hydroxybutyl methacrylate, and 4 mL of ethyl acrylate. The second liquid was a solution obtained by dissolving 0.5 g of potassium peroxodisulfate in 30 mL of ion exchanged water. Subsequently, the temperature inside the flask was maintained at 80° C. for two hours to polymerize the flask contents. As a result, a suspension A-1 of resin particulates was obtained.

(Preparation of Suspension A-2)

A suspension A-2 was prepared according to the same method as for the suspension A-1 in all aspects other than that the amount of styrene was changed from 12 mL to 13 mL, the amount of 2-hydroxybutyl methacrylate was changed from 4 mL to 5 mL, and the amount of ethyl acrylate was changed from 4 mL to 3 mL.

(Preparation of Suspension A-3)

A suspension A-3 was prepared according to the same method as for the suspension A-1 in all aspects other than that the amount of the cationic surfactant (Texnol R5) was changed from 75 mL to 70 mL and a liquid mixture of 13 mL of styrene, 6 mL of 2-hydroxyethyl methacrylate, and 2 mL of methyl acrylate was used as the first liquid in place of the liquid mixture of 12 mL of styrene, 4 mL of 2-hydroxybutyl methacrylate, and 4 mL of ethyl acrylate.

(Preparation of Suspension A-4)

A suspension A-4 was prepared according to the same method as for the suspension A-1 in all aspects other than that the amount of the cationic surfactant (Texnol R5) was changed from 75 mL to 70 mL and a liquid mixture of 12 mL of styrene, 2 mL of 2-hydroxybutyl methacrylate, and 4 mL of butyl acrylate was used as the first liquid in place of the liquid mixture of 12 mL of styrene, 4 mL of 2-hydroxybutyl methacrylate, and 4 mL of ethyl acrylate.

(Preparation of Suspension A-5)

A suspension A-5 was prepared according to the same method as for the suspension A-1 in all aspects other than that the amount of the cationic surfactant (Texnol R5) was changed from 75 mL to 70 mL and a liquid mixture of 12 mL of styrene, 7 mL of 2-hydroxyethyl methacrylate, and 2 mL of methyl acrylate was used as the first liquid in place of the liquid mixture of 12 mL of styrene, 4 mL of 2-hydroxybutyl methacrylate, and 4 mL of ethyl acrylate.

(Preparation of Resin Particles B-1)

A 3-L flask equipped with a thermometer (thermocouple), a nitrogen inlet tube, a stirrer, and a heat exchanger (condenser) was charged with 1000 g of ion exchanged water and 4 g of a cationic surfactant ("Texnol R5" manufactured by NIPPON NYUKAZAI CO., LTD., component: alkyl benzyl dimethyl ammonium salt). Subsequently, nitrogen was introduced into the flask for nitrogen substitution for 30 minutes while stirring the flask contents at a temperature of 30° C. Then, 2 g of potassium peroxodisulfate was added into the flask. The flask contents were stirred to dissolve potassium peroxodisulfate. Then, a temperature inside the flask was increased to 80° C. while introducing nitrogen into the flask. A liquid mixture of 250 g of methyl methacrylate and 4 g of 1,4-butanediol dimethacrylate was dripped into the flask over two hours starting from the time when the temperature inside the flask reached 80° C. During the dripping of the liquid mixture, the flask contents were kept stirred under conditions of a temperature of 80° C. and a rotational speed of 300 rpm. After the dripping, the flask contents were polymerized in a state in which the temperature inside the flask was maintained at 80° C. for eight hours. As a result, emulsion was obtained. Subsequently, the obtained emulsion was cooled to room temperature (approximately 25° C.) and then filtered (solid-liquid separated) to collect a solid. Thereafter, the collected solid was dried to obtain resin particles B-1 (powder).

(Preparation of Resin Particles B-2)

Resin particles B-2 were prepared according to the same method as for the resin particles B-1 in all aspects other than that a liquid mixture of 250 g of methyl methacrylate and 4 g of ethylene glycol dimethacrylate was used in place of the liquid mixture of 250 g of methyl methacrylate and 4 g of 1,4-butanediol dimethacrylate.

(Preparation of Resin Particles B-3)

Resin particles B-3 were prepared according to the same method as for the resin particles B-2 in all aspects other than that the amount of ethylene glycol dimethacrylate was changed from 4 g to 5 g.

Resin particulates contained in the suspensions A-1 to A-5 and resin particles B-1 to B-3 obtained as above had particle diameters (number average primary particle diameters) and glass transition points (Tg) shown in Table 2. For example, resin particulates contained in the suspension A-1 had a number average primary particle diameter of 53 nm and a glass transition point (Tg) of 68° C. The suspensions A-1 to A-5 each were a dispersion of a non-crosslinked resin. The resin particles B-1 to B-3 each were crosslinked resin particles.

[Method for Producing Toner]

(Production of Toner Cores)

An FM mixer ("FM-20B" manufactured by Nippon Coke & Engineering Co., Ltd.) was used to mix 100 g of a first binder resin (the crystalline polyester resin synthesized as above), 300 g of a second binder resin (the non-crystalline polyester resin A synthesized as above), 100 g of a third binder resin (the non-crystalline polyester resin B synthesized as above), 600 g of a fourth binder resin (the non-crystalline polyester resin C synthesized as above), 144 g of a colorant ("Colortex (registered Japanese trademark) Blue 81021" manufactured by SANYO COLOR WORKS, Ltd., component: Phthalocyanine Blue), 12 g of a first releasing agent ("Carnauba wax No. 1" manufactured by S. Kato & Co., component: carnauba wax), and 48 g of a second releasing agent ("NISSAN ELECTOL (registered Japanese trademark) WEP-3" manufactured by NOF Corporation, component: ester wax) at a rotational speed of 2400 rpm.

The resultant mixture was melt-knead using a twin screw extruder ("PCM-30" manufactured by Ikegai Corp.) under conditions of a material feeding rate of 5 kg/hour, a shaft rotational speed of 160 rpm, and a set temperature (cylinder temperature) of 100° C. The resultant melt-knead product was subsequently cooled. The cooled melt-kneaded product was then coarsely pulverized using a pulverizer ("Rotoplex16/8"" manufactured by former TOA MACHINERY MFG CO., LTD.). Subsequently, the resultant coarsely pulverized product was finely pulverized using a jet mill ("Model-I Super Sonic Jet Mill" manufactured by Nippon Pneumatic Mfg. Co., Ltd.). The resultant finely pulverized product was classified using a classifier ("Elbow Jet EJ-LABO" manufactured by Nittetsu Mining Co., Ltd.). As a result, toner cores having Tg of 36° C. and a volume median diameter ($D_{50}$) of 6 μm were obtained.

(First Shell Layer Formation Process)

A 1-L three-necked flask equipped with a thermometer and a stirring impeller was set in a water bath and charged with 300 mL of ion exchanged water. Thereafter, a temperature inside the flask was maintained at 30° C. using the water bath. Subsequently, pH of the flask contents was adjusted to 4 by adding a dilute hydrochloric acid into the flask. Subsequently, 15 mL of a first shell material shown in Table 1 (any of the suspensions A-1 to A-5 specified for each toner) was added into the flask. For example, the suspension A-1 was added as the first shell material into the flask in production of the toner T-1.

Subsequently, 300 g of the toner cores (toner cores produced as above) were added into the flask, and the flask contents were stirred for one hour at a rotational speed of 300 rpm. Subsequently, 300 mL of ion exchanged water was added into the flask.

Subsequently, the temperature inside the flask was increased to 78° C. at a rate of 1° C./minute while stirring the flask contents at a rotational speed of 100 rpm. Once the temperature inside the flask reached 78° C., pH of the flask contents was adjusted to 7 by adding sodium hydroxide into the flask. Subsequently, the flask contents were cooled to room temperature (approximately 25° C.) to obtain a dispersion containing first covered cores (that is, toner mother particles prior to addition of a second shell material described below). The first covered cores each included a toner core and a non-crosslinked resin film covering a surface of the toner core. The non-crosslinked resin film covering the surface of each toner core corresponds to a first domain of a shell layer.

(Washing Process)

The dispersion of the first covered cores obtained as above was filtered (solid-liquid separated) using a Buchner funnel to collect a wet cake of the first covered cores. The collected wet cake of the first covered cores was redispersed in ion exchanged water. Further, dispersion and filtration were repeated five times to wash the first covered cores.

(Drying Process)

Subsequently, the first covered cores were dispersed in an aqueous ethanol solution having a concentration of 50% by mass. Through the above, a slurry of the first covered cores was obtained. Subsequently, the first covered cores in the slurry were dried using a continuous type surface modifier ("Coatmizer (registered Japanese trademark)" manufactured by Freund Corporation) under conditions of a hot air temperature of 45° C. and a blower flow rate of 2 $m^3$/minute. As a result, a powder of the dry first covered cores was obtained.

(Second Shell Layer Formation Process)

Subsequently, 100 parts by mass of the first covered cores and 1.25 parts by mass of a second shell material shown in Table 1 (any of the resin particles B-1 to B-3 specified for each toner) were mixed for one minute using a 10-L FM mixer (product of Nippon Coke & Engineering Co., Ltd.) equipped with a jacket for temperature adjustment while circulating water at a temperature shown in "Formation temperature" in Table 1 through the jacket. For example, in production of the toner T-1, 100 parts by mass of the first covered cores and 1.25 parts by mass of the resin particles B-1 were mixed for one minute using the FM mixer while circulating water at a temperature of 34.5° C. (±2.5° C.) through the jacket of the FM mixer. Through the above mixing, a plurality of crosslinked resin particles adhered to a surface of each first covered core. As a result, a powder of toner mother particles was obtained. The plurality of crosslinked resin particles adhered to the surface of each first covered core correspond to second domains of the shell layer.

Note that in production of the toner T-11, the second shell layer formation process described above was not performed and an external addition process described below was performed next to the drying process. First covered cores of the toner T-11 correspond to the toner mother particles.

(External Addition Process)

The above FM mixer (FM-10B) was charged with 100 parts by mass of the toner mother particles, 1 part by mass of positively chargeable silica particles ("AEROSIL (registered Japanese trademark) REA90" manufactured by Nippon Aerosil Co., Ltd., content: dry silica particles to which positive chargeability was imparted through surface treatment, number average primary particle diameter: 20 nm), and 0.5 parts by mass of conductive titanium oxide particles ("EC-100" manufactured by Titan Kogyo, Ltd., matrix: $TiO_2$ particles, coat layer: Sb-doped $SnO_2$ film, number average primary particle diameter: about 0.35 μm). The toner mother particles and the external additives (silica particles and titanium oxide particles) were mixed using the FM mixer (FM-10B) for five minutes while circulating water at a temperature shown in "Formation temperature" in Table 1 through the jacket of the FM mixer. Through the above, the external additives adhered to surfaces of the toner mother particles. Thereafter, shifting was performed using a 200-mesh sieve (opening: 75 μm). Through the above, each of the toners (toners T-1 to T-11 shown in Table 1) each including a large number of toner particles was obtained. However, the toner T-10 could not be produced since the toner mother particles adhered to one another (agglomerated) in the second shell layer formation process and the external addition process. The toner mother particles adhered to one another (agglomerated) presumably because the treatment temperature (39.5° C.±2.5° C.) was excessively high.

Measurement results of the first coverage and the multiple coverage of the toners T-1 to T-11 obtained as above are shown in Table 1. For example, the toner T-1 had first coverage of 80% and multiple coverage of 70%. The first coverage and the multiple coverage were measured according to respective methods described below.

<Imaging of Cross-Section of Toner Particle>

A sample (toner) was embedded in a visible light curable resin ("ARONIX (registered Japanese trademark) D-800" manufactured by Toagosei Co., Ltd.) to obtain a hardened material. Thereafter, the obtained hardened material was cut at a cutting rate of 0.3 mm/second using an ultrathin piece forming knife ("Sumi Knife (registered Japanese trademark)" manufactured by Sumitomo Electric Industries, Ltd., a diamond knife having a blade width of 2 mm and a blade tip angle of 45°) and an ultramicrotome ("EM UC6" manufactured by Leica Microsystems) to form a thin piece having a thickness of 150 nm. The resultant thin piece was exposed to vapor of an aqueous solution of ruthenium tetroxide on a copper mesh for ten minutes for ruthenium dyeing. Subsequently, a cross-sectional image of the dyed thin piece of the sample was taken using a transmission electron microscope (TEM) ("JSM-6700F" manufactured by JEOL Ltd.).

(Method for Measuring First Coverage)

The first coverage was measured by analyzing the TEM image (cross-sectional image of toner particles) obtained as above using an image analysis software ("WinROOF" manufactured by Mitani Corporation). In the TEM image (cross-sectional image of the toner particles), a proportion (first coverage) of a total length of at least one surface region (outline indicating the perimeter) of a toner core covered by at least one film-shaped domain was measured. Specifically, the first coverage of the toner core was calculated according to an expression "first coverage=100×(total length of surface region covered by film-shaped domain)/(circumferential length of toner core)". The first coverage was measured for ten toner particles included in a sample (toner). An arithmetic mean of the thus obtained ten measured values was taken to be an evaluation value (first coverage) of the sample (toner).

(Method for Measuring Multiple Coverage)

The multiple coverage (proportion of the number of second domains adhering to a surface of the at least one first domain relative to the number of all second domains included in a toner particle) was measured by analyzing the TEM image (cross-sectional image of the toner particles) obtained as above using an image analysis software ("WinROOF" manufactured by Mitani Corporation). In the TEM image (cross-sectional image of the toner particles), the number $X_A$ Of crosslinked resin particles (second shell material) adhering to a surface of at least one first domain (film of first shell material formed on a surface of a toner core) of a shell layer and the number $X_B$ of crosslinked resin particles (second shell material) adhering to the surface of the toner core were counted. The multiple coverage $X_T$ was calculated according to an expression "$X_T=100\times X_A/(X_A+X_B)$".

[Evaluation Methods]

Samples (toners T-1 to T-11) were each evaluated according to evaluation methods described below. However, the toner T-10 that could not be produced was not evaluated.

(High-Temperature Preservability)

A 20-mL polyethylene vessel was charged with 2 g of a sample (toner), and left to stand for three hours in a thermostatic chamber set to a temperature of 58° C. Thereafter, the toner was taken out of the thermostatic chamber and cooled to room temperature to obtain an evaluation toner.

The obtained evaluation toner was placed on a 100-mesh sieve (opening: 150 μm) whose mass was known. A mass of the toner (mass of the toner prior to sifting) was calculated by measuring a total mass of the sieve and the toner thereon. Subsequently, the sieve was set in a powder tester (product of Hosokawa Micron Corporation) and the evaluation toner was sifted in accordance with a manual of the powder tester by shaking the sieve for 30 seconds at a rheostat level of 5. A mass of toner remaining on the sieve (mass of toner after the shifting) was calculated by measuring a total mass of the sieve and the toner thereon after the sifting. A degree of aggregation (unit: % by mass) was calculated from the mass of the toner prior to sifting and the mass of the toner after the sifting according to the following expression.

Degree of aggregation=100×(mass of toner after sifting)/(mass of toner prior to sifting)

A degree of aggregation not greater than 50% by mass was evaluated as good (G) and a degree of aggregation greater than 50% by mass was evaluated as bad (B).

(Preparation of Two-Component Developer)

A two-component developer was prepared by mixing 100 parts by mass of a developer carrier (carrier for "TASKalfa5550ci" manufactured by KYOCERA Document Solutions Inc.) and 10 parts by mass of a sample (toner) for 30 minutes using a ball mill. A lowest fixing temperature and migration of crosslinked resin particles to the carrier were evaluated using the prepared two-component developer as described below.

(Lowest Fixing Temperature)

The lowest fixing temperature was evaluated through formation of an image using the two-component developer prepared as above. An evaluation apparatus used was a printer ("FS-C5250DN" manufactured by KYOCERA Document Solutions Inc. that was modified as the evaluation apparatus so that a fixing temperature was variable) including a heat and pressure applying fixing device of roller-roller type. The two-component developer prepared as above was loaded into a developing device of the evaluation apparatus, and a sample (toner for replenishment use) was loaded into a toner container of the evaluation apparatus.

A solid image (specifically, unfixed toner image) having a size of 25 mm×25 mm was formed on paper of 90 g/m$^2$ (A4-size printing paper) using the above evaluation apparatus in an environment at a temperature of 23° C. and a relative humidity of 60% under conditions of a linear velocity of 200 mm/second and a toner application amount of 1.0 mg/cm$^2$. Subsequently, the paper on which the image had been formed was allowed to pass through the fixing device of the evaluation apparatus.

A fixing temperature set in the evaluation of the lowest fixing temperature ranged from 100° C. to 200° C. Specifically, a lowest temperature (lowest fixing temperature) at which the solid image (toner image) was fixable was measured while the fixing temperature of the fixing device was increased by 5° C. at a time (2° C. at a time around the lowest fixing temperature) from 100° C. Whether or not toner could be fixed was checked by a fold-rubbing test as described below. Specifically, the fold-rubbing test was performed by folding evaluation paper that had passed through the fixing device in half such that a surface on which the image had been formed was folded inwards, and by rubbing a 1-kg weight covered with cloth back and forth on the fold five times. Next, the paper was unfolded and a folded portion (portion of the paper on which the solid image had been formed) was observed. A length of toner peeling of the folded portion (peeling length) was measured. The lowest temperature among temperatures for which the peeling length was no greater than 1 mm was determined to be the lowest fixing temperature. A lowest fixing temperature not higher than 145° C. was evaluated as good (G) and a lowest fixing temperature higher than 145° C. was evaluated as bad (B).

(Carrier Contamination)

A printing durability test was performed by loading the two-component developer prepared as above in a multifunction peripheral ("TASKalfa5550ci" manufactured by KYOCERA Document Solutions Inc.) and printing an image (character pattern) having coverage of 5% successively on 10,000 sheets in an environment at a temperature of 20° C. and a relative humidity of 65% while replenishing the sample (toner).

After the above printing durability test, the two-component developer was taken out of a developing device of the multifunction peripheral, and the toner and the carrier in the two-component developer were separated from each other using a 795-mesh sieve (opening: 16 μm) to obtain an evaluation carrier (carrier after the printing durability test). GC/MS analysis was performed on the obtained evaluation carrier to obtain a GC/MS mass spectrum. Then, an amount of crosslinked resin particles (amount of crosslinked resin particles migrated to the carrier) migrated from the toner to the carrier in the printing durability test and adhered to the carrier was determined. The GC/MS analysis was performed under conditions described below. The amount of crosslinked resin particles migrated to the carrier was determined by a method described below.

(GC/MS Analysis)

The evaluation carrier was used as a measurement target. A gas chromatograph mass spectrometer ("GCMS-QP2010 Ultra" manufactured by Shimadzu Corporation) and a multi-shot pyrolyzer ("PY-3030D" manufactured by Frontier Laboratories Ltd.) were used as measuring devices. A GC column ("Agilent (registered Japanese trademark) J&W Ultra-inert Capillary GC Column DB-5 ms" manufactured by Agilent Technologies Japan, Ltd., phase: allylene phase having a polymer main chain strengthened by introducing allylene to siloxane polymer, inner diameter: 0.25 mm, film thickness: 0.25 μm, length: 30 m) was used as a column. The GC/MS analysis was performed on 100 μg of the measurement target under the following conditions to obtain a mass spectrum (horizontal axis: mass of ion/charge number of ion, vertical axis: detection intensity) including a peak derived from crosslinked resin particles (second shell material).

Thermal decomposition temperature: heating furnace "600° C.", interface portion "320° C."

Heating condition: temperature was raised up to 320° C. from 40° C. at a heating rate of 28° C./minute and then maintained at 320° C. for 5 minutes Carrier gas: helium (He) gas (linear velocity: 36.1 cm/minute)

Column head pressure: 49.7 kPa

Injection mode: split injection (split ratio 1:200)

Charrier flow rate: total flow rate "204 mL/minute", column flow rate "1 mL/minute", purge flow rate "3 mL/minute"

(Method for Determining Amount of Crosslinked Resin Particles Migrated to Carrier)

An amount of crosslinked resin particles adhering to 1 g of the evaluation carrier (amount of crosslinked resin particles migrated to the carrier) was determined based on the mass spectrum (GC/MS method mass spectrum) obtained for the evaluation carrier (measured amount: $Y_B$[g]) by the above GC/MS analysis. Specifically, an amount $Y_A$ (unit: g)

of crosslinked resin particles adhered to the evaluation carrier was determined from a measured peak area derived from the crosslinked resin particles (second shell material) using a calibration curve (calibration curve that shows a relationship between a peak area of the GC/MS method mass spectrum and an amount of adhesion of crosslinked resin particles). Then, the amount $Y_T$ (unit: % by mass) of the crosslinked resin particles migrated to the carrier was calculated according to an expression "$Y_T=100\times Y_A/Y_B$".

An amount $Y_T$ (unit: % by mass) of the crosslinked resin particles migrated to the carrier not greater than 0.10% by mass was evaluated as good (G), and an amount $Y_T$ of the crosslinked resin particles migrated to the carrier greater than 0.10% by mass was evaluated as bad (B).

[Evaluation Results]

Table 3 shows evaluation results of the samples (toners T-1 to T-11). Table 3 shows evaluation results of high-temperature preservability (degree of aggregation), low-temperature fixability (lowest fixing temperature), and carrier contamination (amount of crosslinked resin particles migrated to the carrier).

TABLE 3

| | Toner | High-temperature preservability [% by mass] | Lowest fixing temperature [° C.] | Carrier contamination [% by mass] |
|---|---|---|---|---|
| Example 1 | T-1 | 15 | 140 | 0.09 |
| Example 2 | T-2 | 9 | 136 | 0.07 |
| Example 3 | T-3 | 24 | 136 | 0.07 |
| Example 4 | T-4 | 42 | 130 | 0.04 |
| Example 5 | T-5 | 40 | 130 | 0.04 |
| Example 6 | T-6 | 20 | 138 | 0.07 |
| Comparative example 1 | T-7 | 51 (B) | 128 | 0.05 |
| Comparative example 2 | T-8 | 22 | 146 (B) | 0.13 (B) |
| Comparative example 3 | T-9 | 16 | 138 | 0.12 (B) |
| Comparative example 4 | T-10 | — | — | — |
| Comparative example 5 | T-11 | 77 (B) | 130 | — |

The toners T-1 to T-6 (toners according to Examples 1 to 6) each had the above-described basic features. Specifically, in each of the toners T-1 to T-6, the shell layer included at least one first domain having a film shape and second domains each having a particle shape. The first domain was substantially formed from a non-crosslinked resin (see Tables 1 and 2). The second domains were substantially formed from a crosslinked resin (see Tables 1 and 2). The crosslinked resin had a higher glass transition point (Tg) than the non-crosslinked resin (see Table 1). For example, in the toner T-1, the non-crosslinked resin had Tg of 68° C. (see Table 2) and the crosslinked resin had Tg of 114° C. (see Table 2). In a cross-sectional image of a toner particle, a proportion of a total length of at least one surface region of a toner core covered by the at least one first domain was at least 45% and no greater than 80% relative to a circumferential length of the toner core (see "Coverage" of "First domain" in Table 1). In a cross-sectional image of a toner particle, a proportion of second domains adhering to a surface of the at least one first domain was at least 30% by number and no greater than 70% by number relative to all the second domains included in the toner particle (see "Multiple coverage" of "Second domain" in Table 1).

Further, in a cross-sectional image of toner particles taken as above (see "Imaging of Cross-section of Toner Particle") for each of the toners T-1 to T-6, the second coverage was at least 70% and no greater than 99%, the first shell thickness was at least 10 nm and less than 50 nm, and the second shell thickness was at least 70 nm and no greater than 100 nm. Also, the first domain and the second domains were layered in the stated order on the surface of each toner core to form a layered structure.

As shown in Table 3, the toners T-1 to T-6 hardly contaminated the carrier and were excellent in high-temperature preservability and low-temperature fixability.

What is claimed is:

1. An electrostatic latent image developing toner comprising a plurality of toner particles each including a core and a shell layer disposed over a surface of the core, wherein the shell layer includes at least one first domain having a film shape and second domains each having a particle shape, the at least one first domain is substantially formed from a non-crosslinked resin and the second domains are substantially formed from a crosslinked resin, the crosslinked resin has a higher glass transition point than the non-crosslinked resin, in a cross-sectional image of one of the plurality of toner particles, a proportion of a total length of at least one surface region of the core covered by the at least one first domain is at least 45% and no greater than 80% relative to a circumferential length of the core, and in a cross-sectional image of one of the plurality of toner particles, a proportion of second domains adhering to a surface of the at least one first domain is at least 30% by number and no greater than 70% by number relative to all the second domains included in the toner particle.

2. The electrostatic latent image developing toner according to claim 1, wherein the core has a lower glass transition point than the non-crosslinked resin.

3. The electrostatic latent image developing toner according to claim 2, wherein the at least one first domain is fused with the core, and the second domains are fixed to the core such that a part of each of the second domains is embedded in the core.

4. The electrostatic latent image developing toner according to claim 2, wherein the core has a glass transition point of at least 30° C. and no greater than 40° C., the non-crosslinked resin has a glass transition point of at least 60° C. and no greater than 90° C., and the crosslinked resin has a glass transition point of at least 100° C. and no greater than 150° C.

5. The electrostatic latent image developing toner according to claim 4, wherein the core contains a non-crystalline polyester resin and a crystalline polyester resin, the non-crosslinked resin is a polymer of monomers including a styrene-based monomer, a (meth)acrylic acid alkyl ester, and a (meth)acrylic acid hydroxyalkyl ester, and the crosslinked resin is a polymer of monomers including an acrylic acid-based monomer and a cross-linking agent.

6. The electrostatic latent image developing toner according to claim 5, wherein the acrylic acid-based monomer of the crosslinked resin is a (meth)acrylic acid alkyl ester that includes an alkyl group having a carbon number of at least 1 and no greater than 4 in an ester portion thereof, and the cross-linking agent of the crosslinked resin is a (meth)acrylic acid ester of alkylene glycol.

7. The electrostatic latent image developing toner according to claim 1, wherein the at least one first domain and the second domains are layered in the stated order on the surface of the core to form a layered structure.

8. The electrostatic latent image developing toner according to claim 7, in a cross-sectional image of one of the plurality of toner particles, the at least one first domain has an arithmetic mean height of at least 10 nm and less than 50 nm from the surface of the core, and the second domains have an arithmetic mean height of at least 70 nm and no greater than 100 nm from the surface of the core.

9. The electrostatic latent image developing toner according to claim 8, wherein the non-crosslinked resin is a polymer of monomers including a styrene-based monomer, a (meth)acrylic acid alkyl ester, and a (meth)acrylic acid hydroxyalkyl ester, and the crosslinked resin is a polymer of monomers including an acrylic acid-based monomer and a cross-linking agent.

10. The electrostatic latent image developing toner according to claim 9, wherein the acrylic acid-based monomer of the crosslinked resin is a (meth)acrylic acid alkyl ester that includes an alkyl group having a carbon number of at least 1 and no greater than 4 in an ester portion thereof, and the cross-linking agent of the crosslinked resin is a (meth)acrylic acid ester of alkylene glycol.

11. The electrostatic latent image developing toner according to claim 9, wherein the at least one first domain is fused with the core, and the second domains are fixed to the core such that a part of each of the second domains is embedded in the core.

* * * * *